United States Patent [19]

Lockwood

[11] 4,417,691

[45] Nov. 29, 1983

[54] TURBINE DRIVE WATER SPRINKLER

[75] Inventor: George H. Lockwood, Wilton Manors, Fla.

[73] Assignee: Anthony Manufacturing Corp., Azusa, Calif.

[21] Appl. No.: 211,586

[22] Filed: Dec. 1, 1980

Related U.S. Application Data

[63] Continuation-in-part of Ser. No. 914,507, Jun. 12, 1978, abandoned, which is a continuation-in-part of Ser. No. 740,061, Nov. 8, 1976, abandoned.

[51] Int. Cl.[3] ..... B05B 3/04

[52] U.S. Cl. ..... 239/206; 239/241; 239/DIG. 1

[58] Field of Search ..... 239/70, 97, 98, 203–206, 239/240–242, DIG. 1, 230

[56] References Cited

U.S. PATENT DOCUMENTS

| | | | |
|---|---|---|---|
| 1,919,247 | 7/1933 | Munz . | |
| 1,921,020 | 8/1933 | Birrell . | |
| 2,985,380 | 5/1961 | Rosenkranz . | |
| 3,107,056 | 10/1963 | Hunter | 239/240 |
| 3,117,724 | 1/1964 | Ray . | |
| 3,263,930 | 8/1966 | Friedmann et al. | 239/97 |
| 3,583,638 | 6/1971 | Eby . | |
| 3,602,431 | 8/1971 | Lockwood | 239/206 |
| 3,785,565 | 1/1974 | Perry et al. | 239/206 |
| 3,831,458 | 8/1974 | Takanashi et al. . | |
| 3,888,417 | 6/1975 | Harmon . | |
| 3,930,618 | 1/1976 | Lockwood | 239/230 |
| 3,934,820 | 1/1976 | Phaup | 239/205 |
| 3,948,285 | 4/1976 | Flynn | 239/230 |
| 4,026,471 | 5/1977 | Hunter | 239/206 |
| 4,253,608 | 3/1981 | Hunter | 239/206 |

*Primary Examiner*—John J. Love
*Assistant Examiner*—Michael J. Forman
*Attorney, Agent, or Firm*—Fulwider, Patton, Rieber, Lee & Utecht

[57] ABSTRACT

A water sprinkler includes a turbine drive assembly responsive to water under pressure supplied to the sprinkler for moving a spray head through a prescribed rotational path. The turbine drive assembly drives an incremental motion mechanism coupled to the spray head for rotating the spray head between a plurality of angularly spaced stationary positions, and for maintaining the spray head in each stationary position for a time period sufficient to achieve maximum trajected range of water from the spray head. A reversing assembly can be provided for repeatedly reversing the direction of spray head rotation within a prescribed arcuate path, and the reversing assembly includes means for varying the angular locations of the stationary positions of the spray head upon successive reversals of spray head movement.

41 Claims, 15 Drawing Figures

Fig. 1
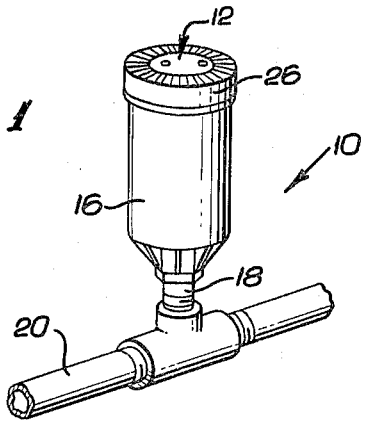
Fig. 2
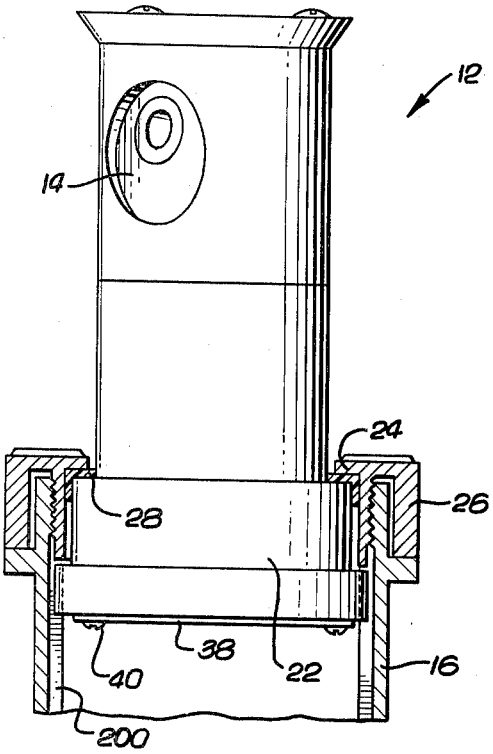
Fig. 4
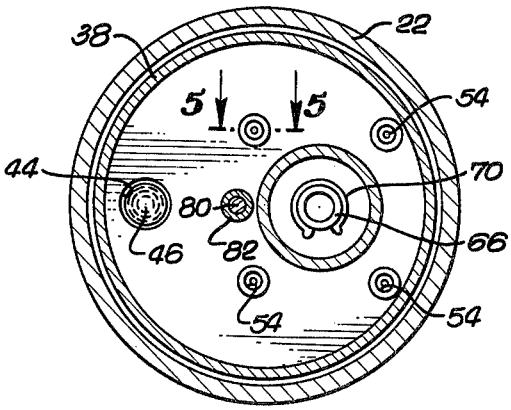
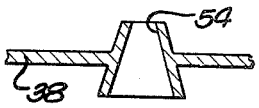
Fig. 5
Fig. 6
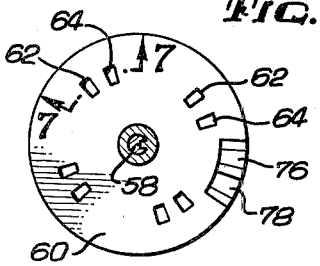
Fig. 7
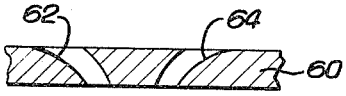
Fig. 8
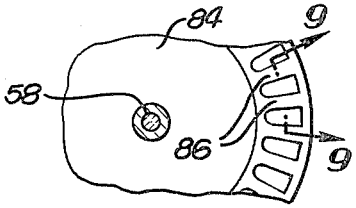
Fig. 9
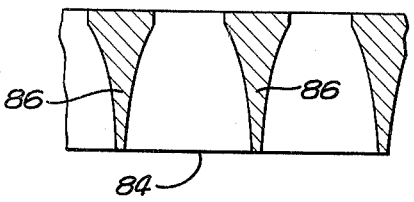

TURBINE DRIVE WATER SPRINKLER

BACKGROUND OF THE INVENTION

This application is a continuation-in-part of copending U.S. Ser. No. 914,507, filed June 12, 1978, now abandoned, which in turn is a continuation-in-part of U.S. Ser. No. 740,061, filed Nov. 8, 1976, and now abandoned.

This invention relates to water sprinkler devices including apparatus for driving a sprinkler spray head through a prescribed arcuate path for irrigation of a soil area. More specifically, this invention relates to a rotating spray head sprinkler including a turbine drive assembly and an incremental motion mechanism for rotationally stepping the spray head between a plurality of angularly spaced stationary positions, and for maintaining the spray head in each stationary position for a time sufficient to achieve maximum trajected range of water. Moreover, this invention relates to such a water sprinkler adapted to include means for altering the angular locations of the spray head stationary positions upon successive rotational movements of the spray head.

A variety of rotating spray head sprinklers are well known in the art. These sprinklers typically include a rotating spray head having a spray nozzle adapted for connection to a supply of water under pressure. The spray nozzle is normally oriented for passage of a stream of the water under pressure in an angularly upwardly and laterally outwardly direction for irrigation of a particular area of soil. A suitable drive means is provided for rotating the spray head at a relatively rapid angular velocity through a rotational path, and if desired, reversing means can be provided for reversing the direction of spray head rotation within a prescribed arcuate portion of the rotational path. Examples of drive means used in the prior art include spring-biased impact arms for periodic interruption of the water streams and corresponding step-wise rotation of the spray head, such as that shown in U.S. Pat. No. 4,182,494, and rotating water turbines for continuous rotation of a spray head, such as that shown in U.S. Pat. No. 3,107,056. Alternately, drive means have been proposed including rotating water turbines for intermittent rotation of a spray head, such as that shown in U.S. Pat. No. 3,117,724.

In rotating water sprinklers in general, it is desirable to rotate the sprinkler spray head at a relatively rapid angular velocity in order to prevent localized overwatering of any portion of the irrigated soil area. Such overwatering results in undesirable pooling of the irrigation water, or alternately, run-off and waste of the water where the soil is not sufficiently porous to absorb the water rapidly. However, it is known that such relatively rapid rotation of the spray head results in a substantial reduction in the trajected range of the water stream discharged from the sprinkler. In contrast, it is further known that sprinklers having slowly rotating spray heads exhibit substantial relative increases in the trajected water stream range, with attendant increases in pooling and overwatering problems. Accordingly, when sprinklers having rapidly rotating spray heads are used, such as those cited hereinabove, a larger number of sprinklers is required to irrigate a prescribed land area, resulting in an increased cost for installation of an irrigation system.

When the water stream from the rotating spray head is initially trajected along a given azimuth, the water stream encounters resistance by static air along the path of trajection. This static air is effective to subdivide and disperse the water stream into relatively fine particles which impact upon the soil within a given range from the sprinkler, depending upon the spray head nozzle design and the water pressure. However, if the water stream trajection is maintained along the same azimuth for a prescribed minimum time period, the static air resisting the water stream is converted into stabilizing circulating air currents flowing generally in parallel with the water stream. This creation of the stabilizing air currents reduces the resistance to the trajected water stream and thereby postpones subdivision and dispersal of the water stream for at least a portion of the trajectory. The result is that the trajected range of the water stream increases to a maximum range over this prescribed minimum time period.

It is therefore desirable to provide a rotating spray head sprinkler including drive means for rotating the spray head through a plurality of incremental angular positions wherein the spray head is maintained stationary at each position for a time period sufficient to allow formation of the stabilizing air currents. However, in the prior art, such rotating spray head sprinklers have not provided satisfactory drive means for accurate positional and timed control of spray head movement through the required incremented steps. Moreover, such prior art devices have not provided satisfactory means for preventing incremental stepping of the spray head at identical stationary positions upon successive rotations through a given azimuth. This stepping of the spray head through identical stationary positions results in substantial overwatering of soil at those stationary positions, and substantial underwatering of the soil between those stationary positions. Still further, the prior art has not provided satisfactory means for reversing the direction of rotation of the spray head within a prescribed arcuate path for so-called part-circle irrigation purposes.

The invention of this application overcomes the problems and disadvantages of the prior art by providing an improved rotating water sprinkler including drive means and an incremental motion mechanism for driving a spray head accurately through a plurality of angularly spaced stationary positions. The spray head is maintained at each stationary position for a time period sufficient to allow maximum range trajection of the water stream. Moreover, the sprinkler of this invention includes a reversing assembly for reversing rotation of the spray head within a controlled arcuate path, and for altering the stationary positions of the spray head upon successive rotations through the arcuate path.

SUMMARY OF THE INVENTION

In accordance with the invention, a water sprinkler is provided for supplying a stream of water under pressure through a spray nozzle in a spray head in an upwardly and radially outward direction for irrigation of a soil area. The water sprinkler includes a drive assembly for rotatably driving an incremental motion mechanism, which in turn rotates the spray head so that the trajected water stream sweeps through an arcuate path for irrigating a substantial area. The incremental motion mechanism rotates the spray head rapidly between a plurality of angularly spaced stationary positions. At each stationary position, the spray head is fixed against rotation for a time period sufficient to achieve maximum range trajection of the water stream, whereupon the spray head is rotated to the next stationary position in succession. A reversing assembly provides controlled reversal of the direction of spray head rotation within a prescribed arcuate path. The reversing assembly includes a lost motion assembly for altering the angular locations of the stationary spray head positions upon successive rotations of the spray head.

The drive assembly includes a water turbine wheel rotatably driven at a relatively high speed by a portion of the water flowing into and through the sprinkler. Pressure control means maintains this portion of the water at a selected pressure so that the turbine wheel is rotated at a constant, predetermined speed. The water turbine wheel rotationally drives a gear train which in turn drives the incremental motion mechanism in the form of a Geneva wheel assembly or the like. The Geneva wheel assembly is coupled to the sprinkler spray head for rotating the spray head through the successive plurality of incremental stationary positions. The spray head is maintained at rest in each stationary position for a time period sufficient to achieve maximum trajected range of the water stream prior to rapid rotation of the spray head to the next successive stationary position.

The reversing assembly includes a plurality of inlet guide vanes adjustable to control the flow direction of the portion of the water driving the turbine wheel, and thereby select the direction of rotation of the turbine wheel. The particular position of adjustment of the guide vanes is controlled by angularly adjustable reversing arms disposed for contacting a stop, and for thereupon shifting the position of adjustment of the guide vanes for reversing the direction of turbine wheel rotation. Such turbine wheel directional reversal rotates the gear train and the Geneva wheel assembly in an opposite direction to correspondingly drive the spray head in an incremental fashion in the opposite rotational direction.

The reversing assembly further includes a bidirectional ratchet mechanism coupled between the incremental motion mechanism and the spray head. This ratchet mechanism includes a first flexible pawl for drivingly engaging a ratchet member in one rotational direction and a second flexible pawl for drivingly engaging the ratchet member in an opposite rotational direction. A pawl release tab rotates into engagement with one of the pawls to retract the pawl from the ratchet member upon rotation in one direction, and holds the pawl in the retracted position momentarily upon reversal of rotation to adjust the angular relationship between the pawls and the ratchet member. In this manner, the angular relationship between the spray head and the incremented motion mechanism is altered upon successive reversals of rotation to correspondingly adjust the angular location of the stationary positions of the spray head.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a turbine drive water sprinkler of this invention;

FIG. 2 is an enlarged elevation view, partially in section, illustrating operation of the water sprinkler of this invention;

FIG. 4 is a reduced horizontal section taken on the line 4—4 of FIG. 3;

FIG. 5 is an enlarged fragmental vertical section taken on the line 5—5 of FIG. 4;

FIG. 6 is a reduced horizontal section taken generally on the line 6—6 of FIG. 3;

FIG. 7 is an enlarged fragmented vertical section taken on the line 7—7 of FIG. 6;

FIG. 8 is a fragmented horizontal section taken generally on the line 8—8 of FIG. 3;

FIG. 9 is an enlarged fragmented vertical section taken on the line 9—9 of FIG. 8;

DETAILED DESCRIPTION OF THE PREFERRED EMBODIMENT

Figure 3:
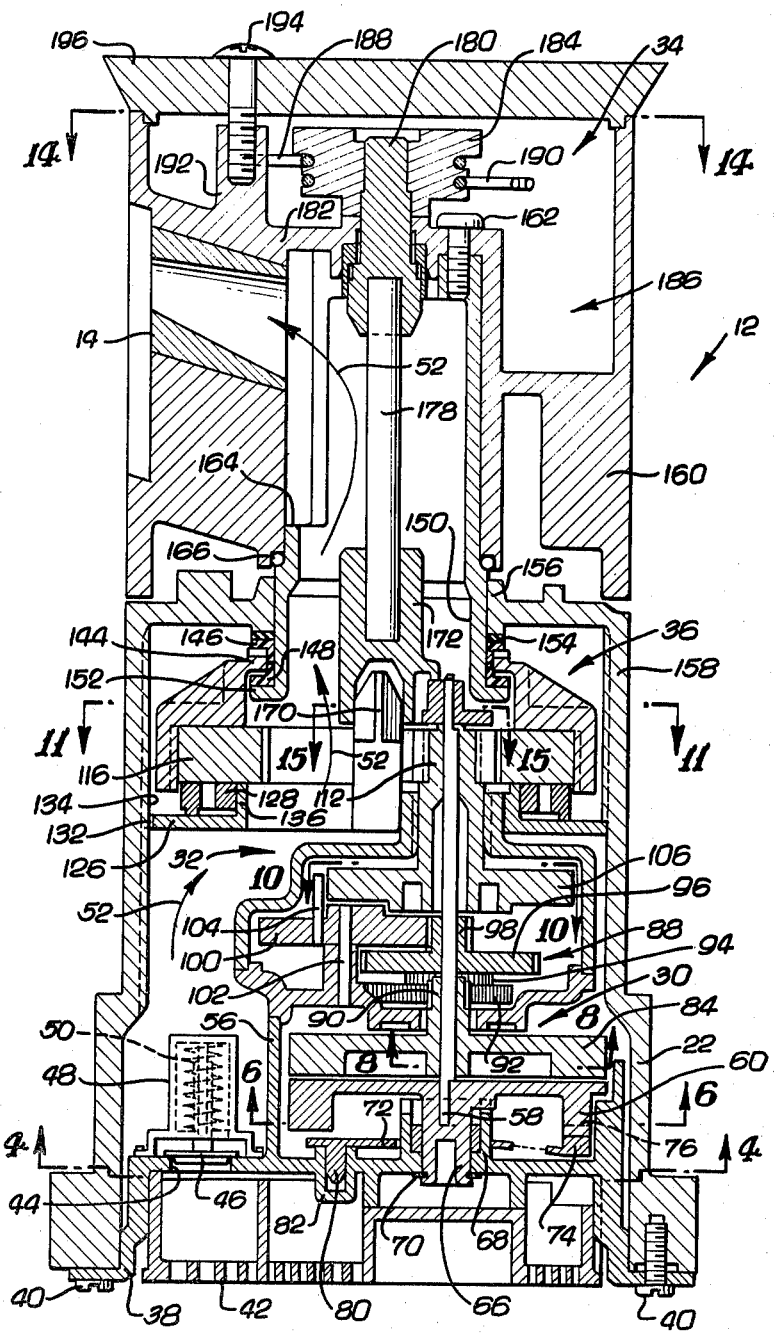
FIG. 3 is an enlarged vertical section of the sprinkler of this invention.

As illustrated in the exemplary drawings, a water sprinkler 10 has a spray head 12 including a spray nozzle 14 for projecting a stream of water in an upwardly and laterally outwardly direction for irrigation of a prescribed soil area. The spray head 12 is carried by a sprinkler housing 16 to which water is supplied under pressure by means of a standpipe 18 connected between the housing and a water supply pipe 20. The housing 18 and the water supply pipe 20 are illustrated in FIG. 1, and can be buried in the ground with the uppermost extent of the housing 16 generally flush with the ground surface. If desired, the water supply pipe 20 can be connected to additional sprinklers 10 as part of an irrigation system, although only one of the sprinklers 10 is shown.

The water sprinkler 10 in this invention is illustrated as a pop-up type sprinkler with the spray head 12 received for vertical sliding movement within the housing 16. More specifically, as shown best in FIG. 2, the spray head 12 has a generally cylindrical shape for sliding reception into the generally cylindrical interior of the housing 16 for movement between a retracted position and a popped-up position. When water under pressure is supplied via the water supply pipe 20 to the interior of the housing 16, the spray head 12 shifts in response to the water pressure to the popped-up position shown in FIG. 2 with the spray nozzle 14 elevated above the housing 16. When supply of water under pressure to the housing 16 ceases, the spray head 12 returns under the influence of gravity to the retracted position within the housing 16, as shown in FIG. 1.

As shown in FIG. 2, the spray head 12 is axially moveable within housing 16 but prevented from rotational movement by suitable splines 200 and includes a radially enlarged lower end or base 22 which is retained within the interior of the housing 16 by a radially inwardly extending flange 24 of a cap 26 threaded onto the upper end of the housing 16. The cap 26 captures an annular seal 28 of L-shaped cross section between the base 22 of the spray head 12 and the flange 24. In this manner, when water under pressure is supplied to the housing 16, the flange 24 provides an upper limit stop for the spray head 12 in the popped-up position, and leakage of water from the interior of the housing 16 between the spray head 12 and the cap 26 is avoided by the seal 28. The water under pressure is thus directed for flow upwardly from the housing 16 into and through the interior of the spray head 12.

As shown in detail in FIG. 3, the spray head 12 of the water sprinkler 10 of this invention includes a drive assembly 30 for rotatably driving the spray nozzle 14. An incremental motion mechanism 32 is coupled between the drive assembly 30 and the spray nozzle 14, and is driven by the drive assembly 30 to provide an incremental motion output for rotating the spray nozzle 14 in a plurality of controlled and intermittent angular steps. A reversing assembly 34 can be adjusted for automatic and repeated reversal of the directional rotation of the spray nozzle 14 back and forth within a selected arcuate range less than 360 degrees. A lost motion assembly 36 is coupled between the spray nozzle 14 and the incremental motion mechanism 32, and operates in conjunction with the reversing assembly 34 for altering the precise angular positions of the spray nozzle rotational steps upon successive reversals of spray nozzle rotation.

The water sprinkler 10 of this invention provides substantial advantages over rotating water sprinklers of the prior art in that the spray nozzle 14 is driven through a plurality of precise incremental stationary positions separated by relatively rapid angular movements between stationary positions. The incremental motion mechanism 32 is designed to maintain the spray nozzle 14 for a time period sufficient to achieve at each stationary position maximum projected range of the water stream discharged from the nozzle 14. The reversing assembly 34 can be appropriately adjusted for reversing the direction of nozzle rotation within the limits of a prescribed arcuate path. Importantly, the lost motion assembly 36 operates in conjunction with the reversing assembly 34 to alter the angular locations of the stationary nozzle positions upon successive reversals of rotational direction to assure uniform watering of the entire irrigated area.

As shown in FIG. 3, water under pressure within the sprinkler housing 16 flows upwardly into the interior of the spray head 12 through a support plate 38 secured over the lower end of the spray head 12 as by screws 40 secured to the spray head base 22. Conveniently, this support plate 38 is dished upwardly to define a downwardly open recess into which a filter screen 42 is received. This filter screen can be secured to the support plate 38 in any suitable manner, such as by an adhesive or by a press-fit relationship, and the filter screen functions to prevent dirt and other particulate carried by the water from passing into the interior of the spray head 12.

The water under pressure flowing into the spray head 12 is divided for passage along two separate paths. A major portion flows through a valve port 44 closed by a poppet valve 46 which is carried within a valve housing 48 and biased to a closed position by a spring 50. The pressure of the water causes the poppet valve 46 to retract from the valve port 44 and thereby allow passage of the water through a relatively open flow path illustrated by arrows 52 in an upward direction within the spray head 12. This upward flow of the water continues to the entrance end of the spray nozzle 14, and this spray nozzle 14 has a converging cross section for passage of the water and projection thereof in the form of a water stream in an upwardly and laterally outwardly direction.

The spring-biased poppet valve 46 operates to maintain a predetermined and substantially constant backpressure in the region upstream of the valve 46. This backpressure is effective to cause a second portion of the water to flow through a plurality of upwardly converging jet nozzles 54 into communication with the drive assembly 30.

The jet nozzles 54 are shown in detail in FIGS. 4 and 5. As shown, four of the nozzles are formed in the support plate 38 in a circular pattern disposed generally to one side of the poppet valve 46. The jet nozzles 54 function to pass relatively small streams of water under pressure in an upward direction into a drive assembly housing 56 (FIG. 3) within the spray head 12. The converging geometries of the jet nozzles 54 assures that these upwardly directed water streams are accelerated to relatively high velocities.

The upwardly accelerated water streams from the jet nozzles 54 pass into communication with a reversing wheel 60 formed to include four sets of passages defining guide vanes 62 and 64 in respective vertical alignment with the jet nozzles 54. This reversing wheel 60 comprises a portion of the reversing assembly 34, and the wheel 60 is secured for rotation with a vertical shaft 58 extending upwardly within the drive assembly housing 56. As illustrated, the lower end of this vertical shaft 58 is carried within a hub 66 of wheel 60 seated within a mating boss 68 formed in the support plate 38. If desired, a C-ring 70 prevents vertically upward movement of the anchor 66 within the boss 68.

The guide vanes 62 and 64 in the reversing wheel 60 comprise upwardly opening passages curved arcuately away from each other in directions normal to the radius of the wheel 60. Thus, water passing upwardly through the guide vane 62 is directed upwardly and circumferentially in one rotational direction, whereas water passing upwardly through the other guide vane is directed upwardly and circumferentially in the opposite rotational direction.

The reversing wheel 60 is indexable between a first rotational position with the guide vanes 62 respectively aligned vertically with the underlying jet nozzles 54, and a second rotational position with the guide vanes 64 respectively aligned with the underlying jet nozzles. Thus, the water passing upwardly through the jet nozzles is caused to swirl in a rotational direction by the guide vanes 62, or by the guide vanes 64, with the rotational direction of swirling motion being governed by the particular indexed position of the reversing wheel 60. A springable holding arm 72 has a locking tab 74 receivable within one of two locking notches 76 and 78 in the reversing wheel 60 to retain the wheel 60 in either its first or second indexed position, with an opposite end of the holding arm 72 being secured to the support plate 38 as shown by the arm stub 80 received in a well 82. Importantly, the reversing wheel 60 is indexed between its two positions by remaining portions of the reversing assembly 34 to be described herein in more detail, and generally as shown and described in U.S. Pat. Nos. 3,602,431 and 3,930,618 issued to applicant.

The water under pressure passing through the reversing wheel 60 flows upwardly with a selected rotational component of velocity into driving communication with a water turbine wheel 84. This turbine wheel 84 is carried for free rotation about the vertical shaft 58, and projects radially from the shaft in vertical alignment with the reversing wheel 60. A plurality of turbine vanes 86 are formed circumferentially about the turbine wheel 84 on a radius generally coinciding with the radial positions of the underlying guide vanes 62 and 64. As shown best in FIGS. 8 and 9, these turbine vanes 86 taper upwardly with increasing thickness to define bidirectional driving surfaces for driving engagement by the water under pressure. The turbine wheel 84 is thus rotationally driven in one direction when the guide vanes 62 are in registry with the jet nozzles 54 and in an opposite direction when the guide vanes 64 are in registry with the jet nozzles 54. As described above, the water under pressure supplied to the turbine wheel is maintained at a substantially constant pressure by the spring-biased poppet valve 46, whereby the turbine wheel 84 is driven by the water at a substantially constant rotational velocity. The water discharged from the turbine wheel 84 flows through appropriate openings in the housing 56 upwardly to the spray nozzle 14.

The water turbine wheel 84 includes an upper projection extending axially about the vertical shaft into an overlying gear train chamber 88 formed within the drive assembly housing 56. The upper end of this projection defines a spur gear 90 in driving communication with a larger, laterally offset gear 92 rotationally carried about a suitable support shaft (not shown). This offset gear 92 is formed integrally with a smaller reduction gear 94 rotatable about the same axis and extending upwardly into meshing engagement with a larger spur gear 96 carried for free rotation about the vertical shaft 58. In turn, this larger spur gear 96 is formed integrally with a relatively small drive gear 98 which extends upwardly about the vertical shaft for meshing engagement with the incremental motion mechanism 32. Importantly, in operation, the intermeshing set of gears described above comprise a gear train for appropriately reducing the low torque, high speed rotation of the turbine wheel 84 into a higher torque, lower speed rotation useful in rotationally driving the spray nozzle, as will be described. The particular design of the gear train and the resultant speed reduction provided thereby is, of course, dependent upon the desired rotational motion characteristics of the spray nozzle 14.

Figure 10:
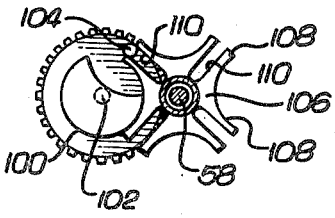
FIG. 10 is a reduced horizontal section taken generally on the line 10—10 of FIG. 3.

The incremental motion mechanism 32 comprises a Geneva wheel assembly, as shown in detail in FIG. 10, and functions to convert the continuous rotational motion from the gear train to an intermittent, step-wise rotational motion for driving the spray nozzle 14. More specifically, the Geneva wheel assembly comprises a spur gear 100 constrained for rotation about an axle pin 102 carried by the drive assembly housing 56. This spur gear 100 is positioned in meshing engagement with the small drive gear 98 of the gear train, and the spur gear 100 carries an upwardly projecting drive pin 104 for rotation about a fixed radius.

The drive pin 104 is positioned for intermittent driving engagement with a Geneva wheel 106 mounted for free rotation about the vertical shaft 58. This Geneva wheel 106 includes, as illustrated in FIG. 10, four radially extending arms 108 defining radially open slots 110 equiangularly spaced about the wheel 106 for reception in sequence of the drive pin 104. More specifically, the arms 108 and the slots 110 are sized and positioned for parallel entry of the drive pin 104 as the drive rotates to correspondingly rotate the Geneva wheel 106 ninety degrees with the drive pin 104 then exiting the slot 110 along an instantaneous path of motion parallel to the slot. Thus, the drive pin 104 rapidly rotates the Geneva wheel 106 ninety degrees during a portion of each single revolution of the drive pin, and then leaves the Geneva wheel 106 at rest for the remaining portion of the revolution of the drive pin. The Geneva wheel is thereby intermittently rotated in regular sequence by the drive pin, and is allowed to remain in a stationary position for a substantial time period between each intermittent rotation. Conveniently, the geometry of the components allowing parallel entry and exit of the drive pin 104 from the slots 110 assures smooth-running operation of the Geneva wheel assembly without substantial wear.

The Geneva wheel 106 includes an upper axial extension 112 which projects upwardly from the drive assembly housing 56 for driving engagement with the lost motion assembly 36. As shown best in FIGS. 3 and 11, the upper end of the Geneva wheel 106 carries a drive gear 112 in meshing engagement with internal gear teeth 114 of a ratchet drive wheel 116. The drive gear 112 on the Geneva wheel 106 thus imparts rotational motion to the ratchet drive wheel 116 in an intermittent step-wise fashion, with the direction of rotational motion being related directly to the direction of rotation of the water turbine wheel 84 of the drive assembly 30.

The ratchet drive wheel 116 includes two flexible pawls 118 and 120 extending angularly in opposite directions for driving engagement with internal ratchet teeth 122 of an annular driven ratchet member 124. The two flexible pawls 118 and 120 are formed from a relatively durable material such as spring steel or the like, and are oriented for driving engagement of the ratchet teeth 122 in opposite directions. Thus, the pawl 118 engages the ratchet teeth 122 upon rotation of ratchet wheel 116 in one direction, whereas the other pawl 120 engages the ratchet teeth 122 upon rotation of the ratchet wheel 116 in the opposite direction.

A support ring 126 slidably carries an adjustment ring 128 including a tab 130 which cooperates with the pawl 118 to adjust the angular relationship between the ratchet drive wheel 116 and the driven ratchet member 124 upon reversals in the rotational direction of the spray head 14. More specifically, the support ring 126 comprises an annular ring positioned generally atop the drive assembly housing 56 and below the ratchet drive wheel 116. This support ring 126 includes a pair of peripheral notches 132 for receiving ridges 134 formed on the inner surface of the spray head 12 to secure the support ring 126 against rotation.

The support ring 126 includes an upwardly extending axial flange 136 about which is received the adjustment ring 128 for relatively free rotation. The adjustment ring carries the tab 130 which extends upwardly through a slot 138 in the ratchet drive wheel 116 for releasable engagement with the pawl 118. Depending upon the direction of rotation of the ratchet drive wheel 116, the tab 130 operates either to allow the pawl 118 to drivingly engage the ratchet teeth 122, or to retract the pawl 118 from the ratchet teeth 122.

Figure 11:
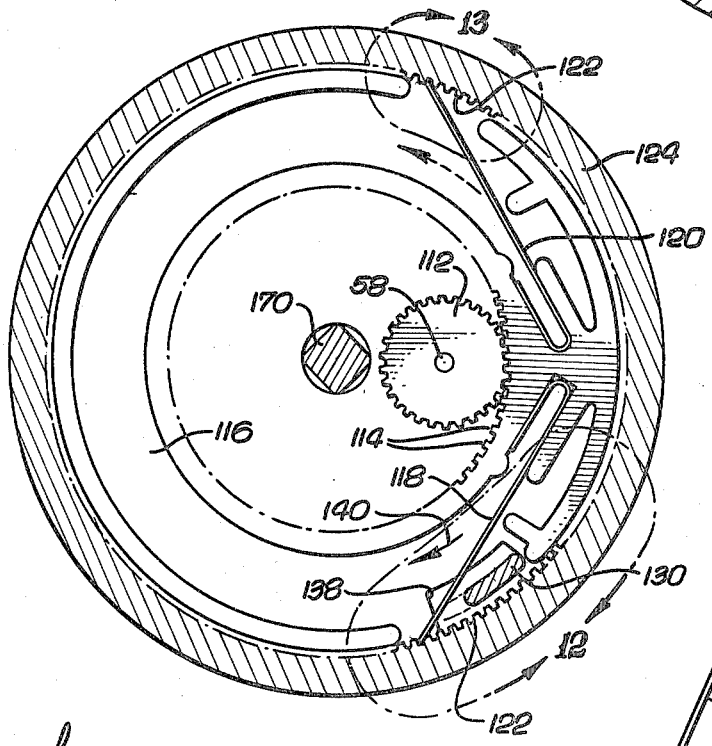
FIG. 11 is an enlarged horizontal section taken on the line 11—11 of FIG. 3.
Figure 13:
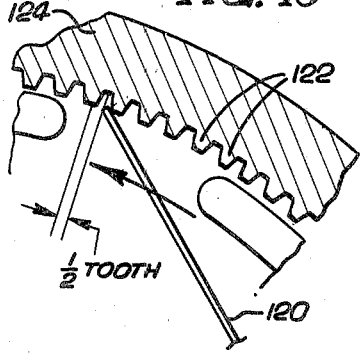
FIG. 13 is an enlarged fragmented horizontal section corresponding generally with the portion 13 of FIG. 11 and illustrating operation of a portion of the sprinkler.

As shown in FIG. 11, when the ratchet drive wheel 116 is rotated in an intermittent step-wise fashion in the direction of arrow 140, the tab 130 slides within the limits of the slot 138 away from the adjacent pawl 118 to allow the pawl 118 to drivingly engage the ratchet teeth 122. When this occurs, the driven ratchet member 124 is rotated along with the ratchet drive wheel 116 in the same intermittent fashion and in the same rotational direction. The other pawl 120 follows along with the ratchet drive wheel 116, as shown in FIG. 13, and the tab 130 is also carried along within the limits of the slot 138 and spaced from the pawl 118.

Figure 12:
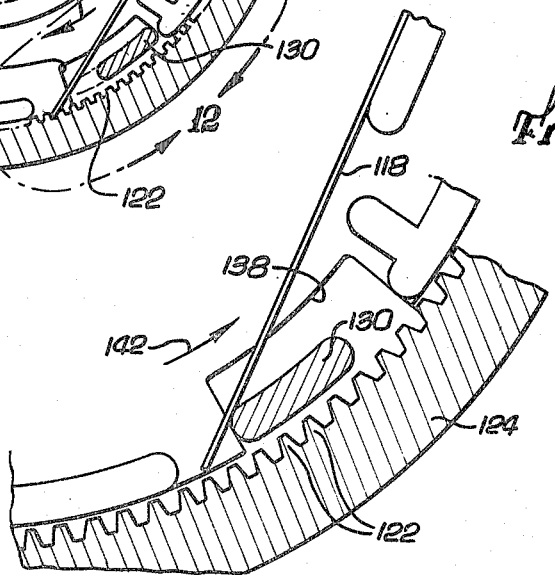
FIG. 12 is an enlarged fragmented horizontal section corresponding generally with the portion 12 of FIG. 11 and illustrating operation of a portion of the sprinkler.

When the rotational direction of the ratchet drive wheel 116 is reversed, as shown by the arrow 142 in FIG. 12, the other pawl 120 drivingly engages the ratchet teeth to drive the driven ratchet member 124 in the opposite rotational direction. This moves the first pawl 118 in a following manner toward the tab 130, and, in effect, moves the tab 130 to the other side of the slot 138. The tab 130 engages the pawl 118 to retract the pawl radially inwardly away from engagement with the ratchet teeth 122.

Upon the next reversal of rotational driving of the ratchet drive wheel 116, the pawl 118 moves from its retracted position toward the ratchet teeth 122 as the ratchet drive wheel 116 is rotated away from the tab 130. This allows the pawl 118 to skip one of the ratchet teeth 122 before driving engagement is once again achieved. Such skipping of a tooth 122 adjusts the angular relationship between the ratchet drive wheel 116 and the driven ratchet member 124. Of course, the tab 130 remains stationary until the opposite end of the slot 138 engages the tab and carries it along with the ratchet drive wheel 116.

As shown in FIG. 3, the driven ratchet member 124 extends annularly upwardly from the ratchet drive wheel 116, and then extends radially inwardly to define a flange 144. This flange 144 is captured between upper and lower annular friction collars 146 and 148 of L-shaped cross section and received snugly about a nozzle cylinder 150. As shown, this nozzle cylinder 150 as an enlarged annular flange 152 to support the lower friction collar 148, and an annular seal 154 is interposed between the upper friction collar 146 and the lower face of a cylindrical boss 156.

The cylindrical boss 156 encloses a lower half 158 of the spray head 12, and allows passage of the nozzle cylinder 150 upwardly into an upper half 160 of the spray nozzle 12. This upper half 160 of the spray nozzle 12 is carried in vertical alignment with the lower half 158 for rotation with respect to the lower half 158. With this construction, the drive assembly 30, the incremental motion mechanism 32, and the lost motion assembly 36 are all carried in the lower half 158 of the spray head against rotation with respect to the sprinkler housing 16 (FIG. 1), while the spray nozzle 14 is carried by the upper half 160 of the spray head 12 for discharging a stream of water rotationally over a prescribed soil area.

As described above, the driven ratchet member 124 is reversibly and rotationally driven in an incremental step-wise fashion, and is coupled to the nozzle cylinder 150 via the friction collars 146 and 148 to impart the same motion to the nozzle cylinder 150. This nozzle cylinder 150 is secured to the upper half 160 of the spray head 12 by means of a screw 162 or the like, and defines a flow path openly communicating with the water under pressure within the lower half 158, as illustrated by the flow arrows 52. One side of the nozzle cylinder 150 includes an opening 164 for passage of the water into and through the spray nozzle 14 carried by the upper half 160 of the spray head. Conveniently, a seal ring 166 interposed between mating shoulders on the upper half 160 and the nozzle cylinder 150 prevent water leakage between the components, and the friction collars 146 and 148 allow slippage of movement to prevent damage to the gear train in the event the upper half 160 of the spray head 12 is forcibly rotated independent of the drive assembly 30.

Thus, in operation, the drive assembly 30 and the incremental motion mechanism 32 drive the nozzle cylinder 150 in a step-wise rotational fashion to correspondingly drive the spray nozzle 14. The spray nozzle 14 is moved in sequence through a plurality of angularly stationary positions separated by relatively rapid angular movement to the next stationary position in succession. Importantly, the gear train and the incremental motion mechanism are designed to maintain the spray nozzle in each stationary position for a minimum time period sufficient to allow the formation of stabilizing air currents along the trajectory of the water stream, and thereby maximize the range of the sprinkler 10. In a typical installation, the time period required to achieve maximum range of the water stream is on the order of about three seconds. Of course, the sprinkler is designed to rotate the spray nozzle 14 to the next successive stationary position promptly upon termination of the time period for achieving maximum stream range.

The drive assembly 30 is further designed to avoid repetition of the stationary nozzle positions at identical rotational locations upon successive rotations of the spray nozzle 14. For example, in the absence of operation of the reversing assembly 34, the spray nozzle 14 will continue to rotate incrementally through a continuous full circle of 360 degrees. However, the spray nozzle 14 rotates, according to the design of the gear train, in angular increments not divisible as a whole number into 360 degrees. One such preferred angular increment comprises 11 degrees. Therefore, upon successive rotations of the spray nozzle 14, the angular locations of the stationary positions vary to assure uniform watering of the entire irrigated soil area.

Figure 15:
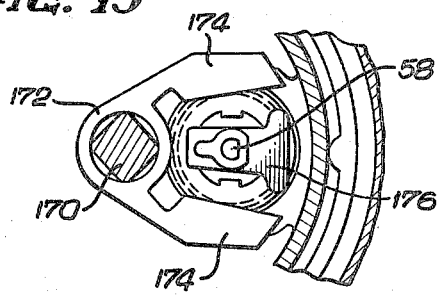
FIG. 15 is an enlarged fragmented horizontal section taken generally on the line 15—15 of FIG. 3.
Figure 14:
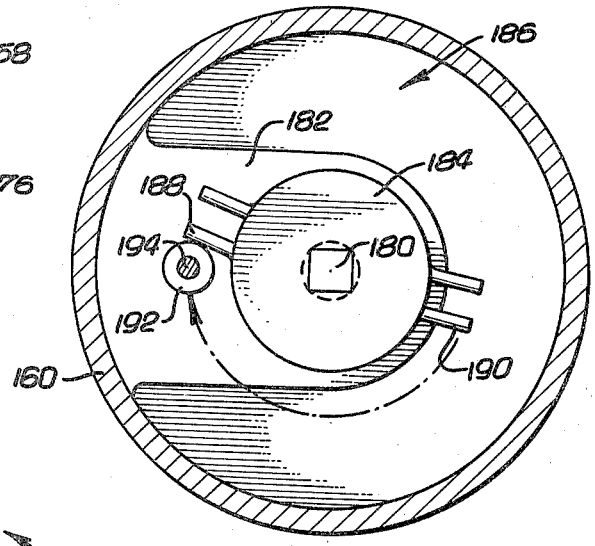
FIG. 14 is a horizontal section taken on the line 14—14 of FIG. 3.

With reference to FIGS. 3 and 14–15, the reversing mechanism 34 comprises apparatus for selecting a prescribed arcuate path less than 360 degrees for the spray nozzle 14, and for indexing the reversing wheel 60 at the underside of the turbine wheel 84 upon reaching an end limit of that prescribed arcuate path. As shown, the reversing assembly 34 comprises a support post 170 formed integrally with the support ring 126 at the upper end of the drive assembly housing 56. This support post 170 provides a base for an operating foot 172 having two angularly spaced toes 174 disposed on opposite sides of a shoe 176 secured to the upper end of the vertical shaft 58. The operating foot 172 is in turn secured to a central shaft 178 which is offset from the vertical shaft 58 and which projects upwardly through the nozzle cylinder 150.

The upper end of the central shaft 178 is secured to a shaft extension 180 which projects through an interior wall 182 in the upper half 160 of the spray head 12. The upper end of this shaft extension 180 has a square cross section for mating reception within a horizontal disk 184 carried within an upper chamber 186. The disk 184 carries two spring arms 188 and 190 which project radially outwardly from the disk, and which can be angularly adjusted with respect to the disk and with respect to each other. Both of these arms 188 and 190 are arranged to contact a stop 192 movable with the spray head 12 through its path of rotation. Conveniently, this stop 192 is internally threaded to receive a screw 194 for fastening a cap 196 over the upper end of the chamber 186.

The spring arms 188 and 190 are angularly adjusted to strike the stop 192 at the opposite end limits of the prescribed arcuate path for the spray nozzle 14. When either end limit is reached, the particular arm 188 or 190 acts through the disk 184 to apply a torque to the shaft 178 and the foot 172. This torque moves the appropriate one of the toes 174 angularly into the shoe 176 at the upper end of the vertical shaft 58, and thereby also applies a torque to the shoe 176 and the vertical shaft 58. The shaft 58 transfers this applied torque to the reversing wheel 60 to index the wheel 60 to its opposite rotational position. As soon as the reversing wheel 60 is indexed, the turbine wheel 84 is rotated in the opposite direction to correspondingly rotate the spray nozzle 14 in the opposite direction. This moves the stop 192 away from the particular spring arm 188 or 190, in an incremental step-wise fashion toward the other spring arm. Of course, when the other arm contacts the stop, a similar reversing action occurs to once again reverse the direction of spray nozzle rotation. Importantly, as described hereinabove, the lost motion assembly 36 responds to the reversal of spray nozzle rotation to alter the angular location of the spray nozzle stationary positions upon each successive rotation.

A variety of modifications and improvements to the invention set forth herein are believed to be apparent to one skilled in the art. According, no limitation of the invention is intended except as set forth in the appended claims.

What is claimed is:

1. A water sprinkler, comprising:

a sprinkler housing for connection to a supply of water under pressure;

a spray head carried by said housing and including a spray nozzle mounted for rotation with respect to said housing, said spray nozzle being oriented for direction of a stream of water radially outwardly from said spray head;

a drive assembly rotationally driven by at least a portion of the water under pressure for providing a continuous rotational output; and an incremental motion mechanism including means coupled between said drive assembly and said spray nozzle for incrementally rotating said spray nozzle through a plurality of angularly spaced stationary positions of controlled duration separated by relatively rapid rotational movements through predetermined angular increments between said stationary positions, said rotational movements being of an angular magnitude such that the angular location of each stationary position is varied upon successive rovolutions of said spray nozzle.

2. The sprinkler of claim 1 including rotational speed control means for holding said spray nozzle against rotation in each of said stationary positions of said spray nozzle for a period of time sufficient to allow formation of stabilizing air currents along the trajectory of the water stream to enable the water stream to achieve maximum trajected range.

3. The sprinkler of claim 2 wherein said spray head includes a first flow path therethrough for passage of a substantial portion of the water under pressure from said housing to said spray nozzle, and a second flow path therethrough for passage of another portion of the water under pressure from said housing into driving communication with said drive assembly and then to said spray nozzle, said control means comprising a pressure control valve oriented along said first path for maintaining a substantially constant backpressure upon the portion of the water directed to said second flow path, whereby said portion of the water directed to said second flow path drivingly rotates said drive assembly at a substantially constant and predetermined rotational speed.

4. The sprinkler of claim 3 wherein said drive assembly includes a water turbine wheel.

5. The sprinkler of claim 3 wherein said drive assembly includes a turbine water wheel mounted within said spray head along said second flow path for relatively high speed rotation in response to water flow through said second flow path, and a speed reduction gear train rotationally driven by said turbine wheel, said gear train including an output gear rotationally driven at a speed comprising said rotational output and coupled to said incremental motion mechanism.

6. The sprinkler of claim 5 including a friction clutch coupled between said incremental motion mechanism and said spray nozzle.

7. The sprinkler of claim 1 wherein said incremental motion mechanism comprises a Geneva wheel assembly for converting said rotational output of said drive assembly to an intermittent rotational output of predetermined angular magnitude.

8. The sprinkler of claim 1 including a reversing assembly for reversing the direction of rotation of said spray nozzle within the limits of a prescribed arcuate path.

9. The sprinkler of claim 8 including a lost motion assembly coupled between said incremental motion mechanism and said spray nozzle, and responsive to reversal of the direction of rotation of said spray nozzle for altering the angular locations of said stationary positions of said spray nozzle upon successive reversals of the direction of spray nozzle rotation.

10. The sprinkler of claim 9 wherein said lost motion assembly comprises a driving ratchet wheel driven by said incremental motion mechanism, a driven ratchet member coupled to said spray nozzle, a plurality of pawls engaged between said driving ratchet wheel and said driven ratchet member for bidirectional driving therebetween, and means for adjusting the angular relationship between said driving ratchet wheel and said driven ratchet member upon reversal of the direction of rotation of said driving ratchet wheel.

11. The sprinkler of claim 10 wherein said plurality of pawls comprises a first pawl mounted for driving engagement between said driving ratchet wheel and said driven ratchet member in one rotational direction, and a second pawl mounted for driving engagement between said driving ratchet wheel and said driven ratchet member in the opposite rotational direction, said adjusting means comprising means for retracting said first pawl from driving engagement in said opposite rotational direction and for maintaining said first pawl in its retracted position for an initial portion of rotational movement in said one direction upon reversal of rotational movement to allow angular slippage between said driving ratchet wheel and said driven ratchet member.

12. The sprinkler of claim 9 wherein said reversing assembly includes means for reversing the rotational direction of said rotational output of said drive assembly when said spray nozzle reaches one of the end limits of said prescribed arcuate path.

13. The sprinkler of claim 12 wherein said drive assembly includes a water turbine wheel, and wherein said reversing means of said reversing assembly comprises a set of guide vanes indexable between a first position for directing a portion of the water for driving said turbine wheel in one rotational direction, and a second position for directing said portion of the water for driving said turbine wheel in the opposite rotational direction.

14. The sprinkler of claim 13 wherein said reversing assembly further includes means for indexing said guide vanes between said first and second positions when the end limits of said prescribed arcuate path are reached, and locking means for retaining said guide vanes in the particular indexed position until the next end limit is reached.

15. The sprinkler of claim 1 wherein said spray head includes a lower half rotationally fixed with respect to said housing and carrying said drive assembly and said incremental motion mechanism, and an upper half mounted for rotation with respect to said lower half and carrying said spray nozzle, and further including means coupled between said incremental motion mechanism and said upper half for driving said upper half and said spray nozzle through said plurality of stationary positions separated by relatively rapid rotational movements.

16. A water sprinkler, comprising:

a sprinkler housing for connection to a supply of water under pressure;

a spray head carried by said housing and including a spray nozzle mounted for rotation with respect to said housing, said spray nozzle being oriented for direction of a stream of water in a radially outward direction from said spray head;

a drive assembly rotationally driven by at least a portion of the water under pressure for providing a continuous rotational output;

an incremental motion mechanism coupled to said drive assembly and driven thereby to provide an incremental output comprising a plurality of stationary positions of controlled duration separated by relatively rapid rotational movements;

a lost motion assembly coupled between said incremental motion mechanism and said spray nozzle for transmitting said incremental output to drive said spray nozzle through a plurality of angularly spaced stationary positions of controlled duration separated by relatively rapid rotational movements through predetermined angular increments; and a reversing assembly for controllably reversing the rotational direction of said incremental output when said spray nozzle reaches an end limit of a prescribed arcuate path of rotation less than 360 degrees for reversing the direction of rotation of said spray nozzle within said prescribed arcuate path, said lost motion assembly including means responsive to such reversal of the rotational direction of said incremental output for adjusting the position of said spray nozzle with respect to said incremental motion mechanism for correspondingly adjusting the angular locations of the stationary positions of said spray nozzle upon successive reversals of the direction of rotation thereof.

17. The sprinkler of claim 16 including rotational speed control means for holding said spray nozzle against rotation in each of said stationary positions of said spray nozzle for a period of time sufficient to allow formation of stabilizing air currents along the trajectory of the water stream to enable the water stream to achieve maximum trajected range.

18. The sprinkler of claim 17 wherein said spray head includes a first flow path therethrough for passage of a substantial portion of the water under pressure from said housing to said spray nozzle, and a second flow path therethrough for passage of another portion of the water under pressure from said housing into driving communication with said drive assembly and then to said spray nozzle, said control means comprising a pressure control valve oriented along said first path for maintaining a substantially constant backpressure upon the portion of the water directed to said second flow path, whereby said portion of the water directed to said second flow path drivingly rotates said drive assembly at a substantially constant and predetermined rotational speed.

19. The sprinkler of claim 18 wherein said drive assembly includes a turbine water wheel mounted within said spray head along said second flow path for relatively high speed rotation in response to water flow through said second flow path, and a speed reduction gear train rotationally driven by said turbine wheel, said gear train including an output gear rotationally driven at a speed comprising said rotational output and coupled to said incremental motion mechanism.

20. The sprinkler of claim 19 including a plurality of jet nozzles for accelerating the water into driving communication with said turbine wheel.

21. The sprinkler of claim 16 wherein said incremental motion mechanism comprises a Geneva wheel assembly.

22. The sprinkler of claim 16 wherein said reversing assembly includes means for reversing the direction of rotation of said drive assembly for reversing said rotational output thereof, and thereby reverse the rotational direction of said incremental output.

23. The sprinkler of claim 22 wherein said drive assembly includes a water turbine wheel and wherein said reversing assembly comprises a set of guide vanes indexable between a first position for directing a portion of the water for driving said turbine wheel in one rotational direction, and a second position for directing said portion of the water for driving said turbine wheel in the opposite rotational direction.

24. The sprinkler of claim 23 wherein said reversing assembly further includes means for indexing said guide vanes between said first and second positions when the end limits of said prescribed arcuate path are reached, and locking means for retaining said guide vanes in the particular indexed position until the next end limit is reached.

25. The sprinkler of claim 24 wherein said indexing means comprises a pair of reversing arms fixed against rotation with said spray nozzle and a stop rotatable with said spray nozzle, said arms being adjustable angularly with respect to said spray nozzle and each other to define the respective end limits of said prescribed arcuate path, each of said arms being coupled to said guide vanes for indexing said guide vanes upon engagement with said stop.

26. The sprinkler of claim 25 wherein said guide vanes comprises a reversing wheel adjacent to said turbine wheel and including a first plurality of flow passages for flow of water therethrough in a direction to drive said turbine wheel in one rotational direction, and a second plurality of flow passages for flow of water therethrough to drive said turbine wheel in an opposite rotational direction.

27. The sprinkler of claim 16 wherein said lost motion assembly comprises a driving ratchet wheel driven by said incremental motion mechanism, a driven ratchet member coupled to said spray nozzle, a plurality of pawls engaged between said driving ratchet wheel and said driven ratchet member for bidirectional driving therebetween, and means for adjusting the angular relationship between said driving ratchet wheel and said driven ratchet member upon reversal of the direction of rotation of said driving ratchet wheel.

28. The sprinkler of claim 27 wherein said plurality of pawls comprises a first pawl mounted for driving engagement between said driving ratchet wheel and said driven ratchet member in one rotational direction, and a second pawl mounted for driving engagement between said driving ratchet wheel and said driven ratchet member in an opposite rotational direction, said adjusting means comprising means for retracting said first pawl from driving engagement in said opposite rotational direction and for maintaining said first pawl in its retracted position for an initial portion of rotational movement in said one direction upon reversal of rotation movement to allow angular slippage between said driving ratchet wheel and said driven ratchet member.

29. The sprinkler of claim 16 wherein said spray head includes a lower half rotationally fixed with respect to said housing and carrying said drive assembly and and said incremental motion mechanism, and an upper half mounted for rotation with respect to said lower half and carrying said spray nozzle, and further including means coupled between said incremental motion mechanism and said upper half for driving said upper half and said spray nozzle through said plurality of stationary positions separated by relatively rapid rotational movements.

30. A water sprinkler, comprising:

a sprinkler housing for connection to a supply of water under pressure;

a spray head having a lower half carried by said housing and fixed against rotation with respect to said housing, and an upper half rotatable with respect to said housing and carrying a spray nozzle oriented for direction of a stream of water in a radially outwardly direction from said spray head;

means for dividing the water under pressure for flow along a first path and along a second path formed within said spray head, said flow paths both being coupled to said spray nozzle;

pressure control means along said first path for maintaining a substantially constant pressure upon the portion of the water directed for flow along said second path;

a drive assembly within said spray head lower half along said second path and including a water turbine wheel rotationally driven at substantially constant speed by the portion of the water in said second path, and speed reduction means driven by said turbine wheel for providing a substantially constant speed rotational output; and an incremental motion mechanism including means coupled between said speed reduction means and said spray head upper half for converting said constant speed rotational output to an incremental rotational output consisting of angularly spaced stationary positions of controlled duration separated by relatively rapid rotational movements through predetermined angular increments having an angular magnitude such that the angular locations of the stationary positions are varied upon successive revolutions of said spray head upper half.

31. The sprinkler of claim 30 including rotational speed control means for holding said spring against rotation in each of said stationary positions of said spray nozzle for a period of time sufficient to allow formation of stabilizing air currents along the trajection of the water stream to enable the water stream to achieve maximum trajected range.

32. The sprinkler of claim 30 wherein said speed reduction means comprises a gear train.

33. The sprinkler of claim 30 wherein said incremental motion mechanism comprises a Geneva wheel assembly.

34. The sprinkler of claim 30 including a reversing assembly for reversing the direction of rotation of said spray nozzle within the limits of a prescribed arcuate path.

35. The sprinkler of claim 34 including a lost motion assembly coupled between said incremental motion mechanism and said spray nozzle, and responsive to reversal of the direction of rotation of said spray nozzle for altering the angular locations of said stationary positions of said spray nozzle upon successive reversals of the direction of spray nozzle rotation.

36. The sprinkler of claim 35 wherein said lost motion assembly comprises a driving ratchet wheel driven by said incremental motion mechanism, a driven ratchet member coupled to said spray nozzle, a plurality of pawls engaged between said driving ratchet wheel and said driven ratchet member for bidirectional driving therebetween, and means for adjusting the angular relationship between said driving ratchet wheel and said driven ratchet member upon reversal of the direction of rotation of said driving ratchet wheel.

37. The sprinkler of claim 36 wherein said plurality of pawls comprises a first pawl mounted for driving engagement between said driving ratchet wheel and said driven ratchet member in one rotational direction, and a second pawl mounted for driving engagement between said driving ratchet wheel and said driven ratchet member in an opposite rotational direction, said adjusting means comprising means for retracting said first pawl from driving engagement in said opposite rotational direction and for maintaining said first pawl in its retracted position for an initial portion of rotational movement in said one direction upon reversal of rotation movement to allow angular slippage between said driving ratchet wheel and said driven ratchet member.

38. The sprinkler of claim 34 wherein said reversing assembly comprises a set of guide vanes indexable between a first position for directing a portion of the water for driving said turbine wheel in one rotational direction, and a second position for directing said portion of the water for driving said turbine wheel in the opposite rotational direction.

39. The sprinkler of claim 38 wherein said reversing assembly further includes means for indexing said guide vanes between said first and second positions when the end limits of said prescribed arcuate path are reached, and locking means for retaining said guide vanes in the particular indexed position until the next end limit is reached.

40. The sprinkler of claim 39 wherein said indexing means comprises a pair of reversing arms fixed against rotation with said spray nozzle and a stop rotatable with said spray nozzle, said arms being adjustable angularly with respect to said spray nozzle and each other to define the respective end limits of said prescribed arcuate path, each of said arms being coupled to said guide vanes for indexing said guide vanes upon engagement with said stop.

41. The sprinkler of claim 40 wherein said guide vanes comprises a reversing wheel adjacent to said turbine wheel and including a first plurality of flow passages for flow of water therethrough in a direction to drive said turbine wheel in one rotational direction, and a second plurality of flow passages for flow of water therethrough to drive said turbine wheel in an opposite rotational direction.

* * * * *